US006773482B2

(12) United States Patent
Liebfahrt et al.

(10) Patent No.: US 6,773,482 B2
(45) Date of Patent: Aug. 10, 2004

(54) COLD WORK STEEL ALLOY FOR THE MANUFACTURE OF PARTS BY POWDER METALLURGY

(75) Inventors: Werner Liebfahrt, Kapfenberg (AT); Roland Rabitsch, Schladming (AT)

(73) Assignee: Bohler Edelstahl, GmbH, Kapfenberg (AT)

( * ) Notice: Subject to any disclaimer, the term of this patent is extended or adjusted under 35 U.S.C. 154(b) by 96 days.

(21) Appl. No.: 10/118,078

(22) Filed: Apr. 9, 2002

(65) Prior Publication Data

US 2003/0068248 A1 Apr. 10, 2003

(30) Foreign Application Priority Data

Apr. 11, 2001 (AT) ..... 587/2001

(51) Int. Cl.[7] ..... B22F 3/15; C22C 33/02

(52) U.S. Cl. ..... 75/243; 75/244; 75/246; 419/11; 419/14; 419/28; 419/49

(58) Field of Search ..... 75/243, 244, 246; 419/11, 14, 28, 49; 420/10, 11, 12

(56) References Cited

U.S. PATENT DOCUMENTS

| | | | | | |
|---|---|---|---|---|---|
| 4,863,515 | A | * | 9/1989 | Roberts et al. | 75/238 |
| 4,936,911 | A | * | 6/1990 | Roberts et al. | 75/238 |
| 5,160,553 | A | * | 11/1992 | Leban et al. | 148/318 |
| 5,578,773 | A | * | 11/1996 | Wisell | 75/246 |
| 5,936,169 | A | * | 8/1999 | Pinnow et al. | 75/246 |
| 5,976,459 | A | * | 11/1999 | Eisen et al. | 419/49 |
| 6,506,227 | B1 | * | 1/2003 | Tornberg | 75/246 |

OTHER PUBLICATIONS

German Industrial Standard DIN 50 602, Sep. 1985.

* cited by examiner

*Primary Examiner*—Ngoclan Mai
(74) *Attorney, Agent, or Firm*—Greenblum & Bernstein, P.L.C.

(57) ABSTRACT

A cold work steel alloy for the manufacture of parts, comprising the elements C, Si, Mn, Cr, W, Mo, V, Nb, Co, S, N, Ni and accompanying elements in the concentration ranges recited in claim 1 and having an oxygen content of less than 100 ppm and a content of nonmetallic inclusions corresponding to a K0 value of a maximum of 3 when tested according to DIN 50 602, as well as a method of making a part of said steel alloy by powder metallurgy.

31 Claims, 4 Drawing Sheets

COLD WORK STEEL ALLOY FOR THE MANUFACTURE OF PARTS BY POWDER METALLURGY

CROSS-REFERENCE TO RELATED APPLICATIONS

The present application claims priority under 35 U.S.C. §119 of Austrian Patent Application No. 587/2001, filed Apr. 11, 2001.

BACKGROUND OF THE INVENTION

1. Field of the Invention

The invention relates to a cold work steel alloy for the manufacture of parts by powder metallurgy, particularly tools, with a high degree of toughness and hardness as well as resistance to wear and material fatigue.

2. Discussion of Background Information

As a rule, tools and tool parts are stressed in many different ways, which necessitates a corresponding property profile of the same. However, creating a particularly good suitability for one type of stress of the material is naturally associated with a deterioration of the resistance of the same to other stresses, so that in many cases several property features should be present at a high level for a high functional quality of a tool, in other words, the functional properties of a tool represent a compromise regarding the respective individual material values. However, for economic reasons there is a general desire to have tools or parts available with overall improved material properties.

Heavy-duty tool steel components consistently have a hard phase component of carbides and a matrix phase part accepting these, which phases depend on the chemical composition of the alloy, particularly regarding their proportions in the material.

With a conventional production with a solidification of the alloy in casting molds, its respective content of carbon and carbide-forming elements is limited due to the solidification kinetics because, with high contents, the carbides primarily precipitated from the melt result in a coarse, inhomogeneous material structure, thus creating poor mechanical properties and adversely affecting, or ultimately precluding, the material's workability.

In order on the one hand to make it possible to increase the concentrations of the carbide-forming elements and the carbon proportion with regard to an increased carbide proportion and thus an improved wear resistance of the material, while on the other hand still ensuring adequate workability, homogeneity and toughness of the parts or tools made therefrom, a manufacture of the same by powder metallurgy is to be provided.

A manufacture of materials by powder metallurgy (PM) essentially includes gas or nitrogen atomization or fragmentation of a steel melt into fine droplets which are solidified into metal powder at a high solidification rate, placing and compressing the metal powder into or in a capsule, sealing the capsule and heating and hot isostatic pressing (HIP) of the powder in the capsule to produce a dense, homogeneous material. A PM material produced in this way can be used directly as-HIPed for manufacturing parts or tools, or subjected beforehand to a hot working, e.g., by forging and/or rolling.

In terms of stress, highly stressed tools or parts, e.g., knives, punches, dies and the like simultaneously require the material to have resistance to abrasive wear, a high degree of toughness and resistance to fatigue. A high proportion of hard, optionally coarse carbides, preferably monocarbides, should be aimed for to reduce wear, although the toughness of the material is reduced with an increasing proportion of carbides. On the other hand, high matrix hardness and low crack initiation by carbide grains and nonmetallic inclusions promote resistance to fatigue, i.e., essentially the absence of cracking at very high pulsating or changing mechanical straining of the material.

As mentioned above, the functional quality of parts or tools represents a compromise between wear resistance, toughness and resistance to fatigue of the material in a thermally treated state. In terms of a general improvement in the quality of cold work steels, attempts have long been made in the technical field to improve the steel property profile as a whole.

SUMMARY OF THE INVENTION

Taking into account the requirements, the object of the present invention is to simultaneously increase the mechanical characteristics in a thermally treated state, i.e., the bend fracture strength, impact bending work and wear resistance of the tool steel material in a quality assured way.

This object is attained according to the invention with a cold work steel alloy containing in percent by weight:

| | |
|---|---|
| Carbon (C) | 2.05 to 2.65 |
| Silicon (Si) | up to 2.0 |
| Manganese (Mn) | up to 2.0 |
| Chromium (Cr) | 6.10 to 9.80 |
| Tungsten (W) | 0.50 to 2.40 |
| Molybdenum (Mo) | 2.15 to 4.70 |
| Vanadium (V) | 7.05 to 9.0 |
| Niobium (Nb) | 0.25 to 2.45 |
| Cobalt (Co) | up to 10.0 |
| Sulfur (S) | up to 0.3 |
| Nitrogen (N) | 0.04 to 0.22 |
| Nickel (Ni) | up to 1.50 |

and accompanying elements up to 2.6 and production-related impurities with the balance being iron (Fe) for the powder metallurgical manufacture of parts with a high degree of toughness and hardness as well as resistance to wear and material fatigue, in particular tools, which parts have an oxygen (O) content of less than 100 ppm and a content and configuration of nonmetallic inclusions corresponding to a K0 value of a maximum of 3 according to testing according to DIN 50 602.

Accordingly, the present invention provides a cold work steel alloy comprising, in percent by weight:

| | |
|---|---|
| C | 2.05 to 2.65 |
| Si | up to 2.0 |
| Mn | up to 2.0 |
| Cr | 6.10 to 9.80 |
| W | 0.5 to 2.4 |
| Mo | 2.15 to 4.70 |
| V | 7.05 to 9.0 |
| Nb | 0.25 to 2.45 |
| Co | up to 10.0 |
| S | up to 0.3 |
| N | 0.04 to 0.32 |
| Ni | up to 1.50 |
| accompanying elements | up to 2.6 |

as well as production-related impurities, with the balance being iron. The alloy has an oxygen content of less than 100 ppm and a content of nonmetallic inclusions corresponding to a K0 value of a maximum of 3 when tested according to DIN 50 602.

In one aspect, the nitrogen content of the alloy is up to 0.22 percent by weight. In another aspect, the alloy comprises one or more element(s) in the following weight percentages: C 2.30 to 2.59; Si 0.80 to 1.50; Mn 0.30 to 1.40; Cr 6.12 to 7.50; Ni up to 1.0; W 0.60 to 1.45; Mo 2.40 to 4.40; V 7.40 to 8.70; Nb 0.50 to 1.95; N 0.06 to 0.25; and the value (Mn-S) is at least 0.19. In yet another aspect, the alloy comprises one or more element(s) in the following weight percentages: Si 0.85 to 1.30; Mn 0.40 to 0.80; Cr 6.15 to 6.95; Ni up to 0.90; Mo 3.55 to 4.40; V 7.80 to 8.59; Nb 0.75 to 1.45; and N 0.06 to 0.15.

In another aspect, the cold work steel alloy is in the form of a part, e.g., in the form of a tool. In a still further aspect, the alloy is in the form of a metal powder. Said metal powder may have a grain size distribution wherein at least 60% of the grains have a grain size of not more than 100 μm and/or may have been produced by gas (e.g., nitrogen) atomization of a liquid alloy.

In yet another aspect, the alloy in the form of a part comprises monocarbides having a diameter of less than 10 μm, e.g., less than 4 μm. In a further aspect, the part has been produced by a process comprising hot isostatic pressing of a metal powder. The metal powder may have a grain size distribution wherein at least 60% of the grains have a grain size of not more than 100 μm.

The present invention also provides a method for making a part of a cold work steel alloy, said method comprising conditioning and atomizing with a gas a liquid alloy which comprises, in percent by weight:

| | |
|---|---|
| C | 2.05 to 2.65 |
| Si | up to 2.0 |
| Mn | up to 2.0 |
| Cr | 6.10 to 9.80 |
| W | 0.50 to 2.40 |
| Mo | 2.15 to 4.70 |
| V | 7.05 to 9.0 |
| Nb | 0.25 to 2.45 |
| Co | up to 10.0 |
| S | up to 0.3 |
| N | 0.04 to 0.32 |
| Ni | up to 1.50 |
| accompanying elements | up to 2.6 |

as well as production-related impurities, with the balance being iron. The gas is nitrogen having a purity of at least 99.999%. Thereby a metal powder with a grain size distribution wherein at least 60% of the grains have a grain size of not more than 100 μm is produced. Thereafter, while maintaining the nitrogen atmosphere and avoiding a physisorption of oxygen at the grain surfaces, the metal powder is subjected to a hot isostatic pressing process to produce a completely dense material comprising evenly distributed monocarbides of a diameter of less than 10 μm.

In one aspect, the part, e.g., a tool, has an oxygen content of less than 100 ppm and in another aspect, it has a content of nonmetallic inclusions corresponding to a K0 value of a maximum of 3 when tested according to DIN 50 602. In a still further aspect of the method, the monocarbides have a diameter of less than 4 μm.

In yet another aspect, the hot isostatic pressing process is followed by a hot working process. This hot working process may comprise forging and/or rolling.

In a still further aspect of the present method, the alloy comprises one or more element(s) in the following weight percentages: C 2.30 to 2.59; Si 0.80 to 1.50; Mn 0.30 to 1.40; Cr 6.12 to 7.50; Ni up to 1.0; W 0.60 to 1.45; Mo 2.40 to 4.40; V 7.40 to 8.70; Nb 0.50 to 1.95; N 0.06 to 0.25; and the value (Mn-S) is at least 0.19. In yet another aspect, the alloy comprises one or more element(s) in the following weight percentages: Si 0.85 to 1.30; Mn 0.40 to 0.80; Cr 6.15 to 6.95; Ni up to 0.90; Mo 3.55 to 4.40; V 7.80 to 8.59; Nb 0.75 to 1.45; and N 0.06 to 0.15.

The considerable improvements in the quality of the material according to the invention are achieved synergetically by alloy technology and process-related measures with regard to optimizing the microstructure as well as individual and overall properties of the microstructural phases.

It has been recognized that not only the carbide amount but also, for the same amount, the carbide morphology, are important for the toughness of the material, because this depends on the free length of path between the carbides in the matrix, i.e., the defect size. As far as the wear resistance is concerned, in the finished tool designated for use, the carbides should essentially be monocarbides, homogeneously distributed in the matrix and with a diameter of less than 10 μm, preferably less than 4 μm.

Vanadium and niobium are the most powerful carbide-formers and should be provided jointly in a concentration range of 7.05 to 9.0 percent by weight of V and 0.25 to 2.45 percent by weight of Nb, respectively for reasons of alloy technology. As a result, on the one hand a formation of monocarbides and, in particular, of advantageous (VNb) composite carbides, is achieved, and on the other hand, due to V and Nb there is such a carbon affinity in the material in these concentration ranges that the other carbide-forming elements chromium, tungsten and molybdenum are available in the concentrations according to the invention with the residual carbon for mixed crystal strengthening and increase the matrix hardness. Higher vanadium and/or niobium contents than 9.0 or 2.45 percent by weight, respectively, have the effect of reducing the matrix strength, and in particular reduce the fatigue resistance of the material, whereas lower contents than 7.05 percent by weight of V and/or 0.25 percent by weight of Nb lead to increased formation of softer carbide phases such as $M_7C_3$ carbides, as a result of which the wear resistance of the steel is reduced.

With a carbon content in the narrow range of 2.05 to 2.65 percent by weight and the concentrations of the monocarbide-formers according to the invention, the secondary hardness potential of the alloy can be utilized during heat treatment and the retention of hardness of the same can be improved, particularly with 0.5 to 2.4 percent by weight of tungsten and 2.15 to 4.70 percent by weight of molybdenum. Chromium with contents of 6.10 to 9.80 percent by weight is provided for a mixed crystal strengthening, with nitrogen in a proportion of 0.04 to 0.22 percent by weight to increase the secondary hardness and the matrix hardness of the tool steel being essential for the invention.

Higher, as well as lower contents than those given in the limits according to the invention for the elements tungsten, molybdenum and chromium, respectively disturb the synergy and reduce at least one property of the tool steel, and thus to some extent can have an adverse effect on its usability.

As mentioned at the outset, in addition to the requirements of alloy technology, the production technology measures are also essential to achieve a high functional quality of a part or of the tool. Since in terms of high material toughness a local accumulation of possibly coarser carbides, a so-called carbide cluster formation, should be avoided in the hot isostatically pressed material because of a minimization of defect sizes, in the powder metallurgical manufacture or in the powder production, the powder grain size distribution should be controlled process-technologically such that at least 60% of the powder grains have a particle size of less than 100 microns (μm). As has been found, a high solidification rate of the melt droplets associated with small metal powder particles results in an even distribution of fine monocarbides and, regarding the carbon content, a supersaturated basic mass in the powder grain.

During hot isostatic pressing and during an optionally provided hot working of the compact, the degree of supersaturation of the basic mass is reduced due to the diffusion at high temperature, the fine, round monocarbides grow as desired up to a size of less than 10 $\mu$m, with the other alloy elements being largely specifically incorporated into the mixed crystal and ultimately strengthening the matrix. Through this manufacturing technology, the carbide morphology is controlled with regard to the smallest defect size and the matrix composition in the direction of maximizing the secondary hardness potential, given the composition of the material according to the invention. In this context, the provided niobium concentration for the controlled grain growth should be mentioned again because of its importance.

The degree of oxidic purity of the material according to the invention is of particular significance, because not only its mechanical properties may be compromised by nonmetallic inclusions, but also because these nonmetals may also cause detrimental seeding effects during solidification and heat treatment of the material. It is thus essential to the invention for a highly pure alloy to be atomized by means of nitrogen having a degree of purity of at least 99.999% nitrogen and a physisorption of oxygen at the powder grain surface to be avoided until enclosed in a capsule, as a result of which the HIPed material has an oxygen content of less than 100 ppm and a content and configuration of nonmetallic inclusions corresponding to a K0 value of a maximum of 3 according to testing according to DIN 50 602.

Preferred embodiments are characterized in the dependent claims. The invention will be explained in further detail on the basis of results from comparative studies.

BRIEF DESCRIPTION OF THE DRAWINGS

The present invention is further described in the detailed description which follows, in reference to the noted plurality of drawings. In these drawings there are shown.

DETAILED DESCRIPTION OF THE INVENTIONS

Table 1 shows the chemical composition of a cold work steel alloy according to the invention (alloy A) and those of the comparative alloys (B through J).

The test results for bend fracture strength, impact bending work and wear resistance of alloy A according to the invention and of comparative alloys B through J are given in Table 2.

Figure 1:
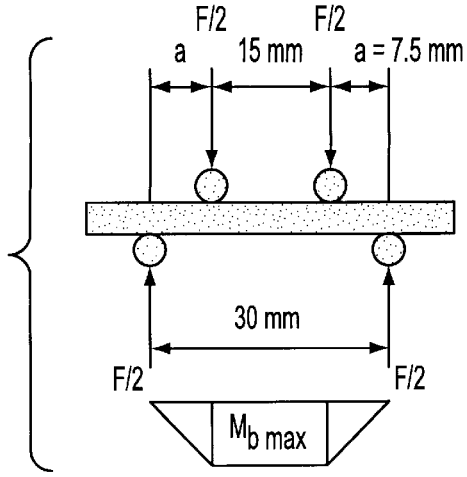
FIG. 1 Measuring arrangement for determining bend fracture strength

The bend fracture strength of the steel alloys was determined on round samples ($R_d$=5.0 mm) heat-treated to 61 HRC in a device according to FIG. 1. The initial force F was 200 N, the rate up to initial force was 2 mm/min and the testing rate was 5 mm/min.

Figure 2:
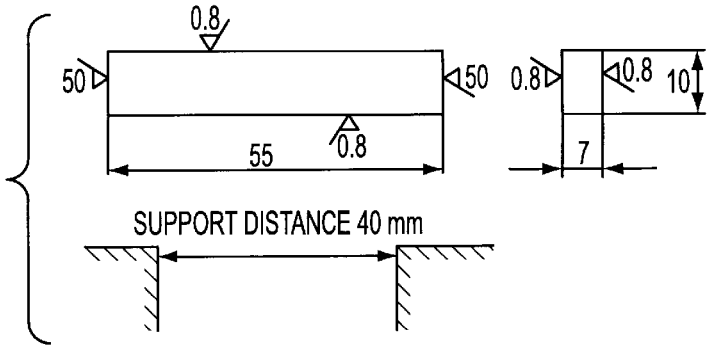
FIG. 2 Sample shape for determining the impact bending work

The tests of the impact bending work of the respective steel alloys were done with samples having the shape according to FIG. 2.

Figure 3:
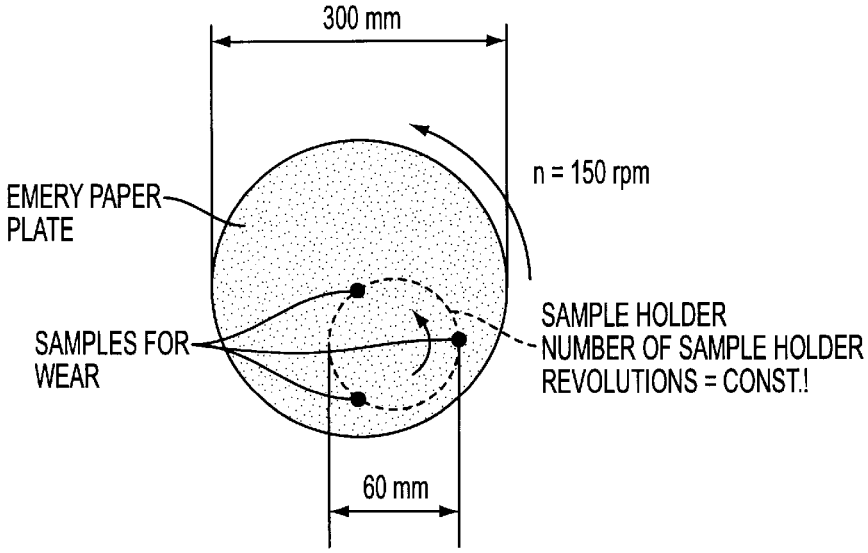
FIG. 3 Device for measuring wear resistance (mechanical diagram)

FIG. 3 shows diagrammatically the device for determining the wear resistance.

Figure 4:
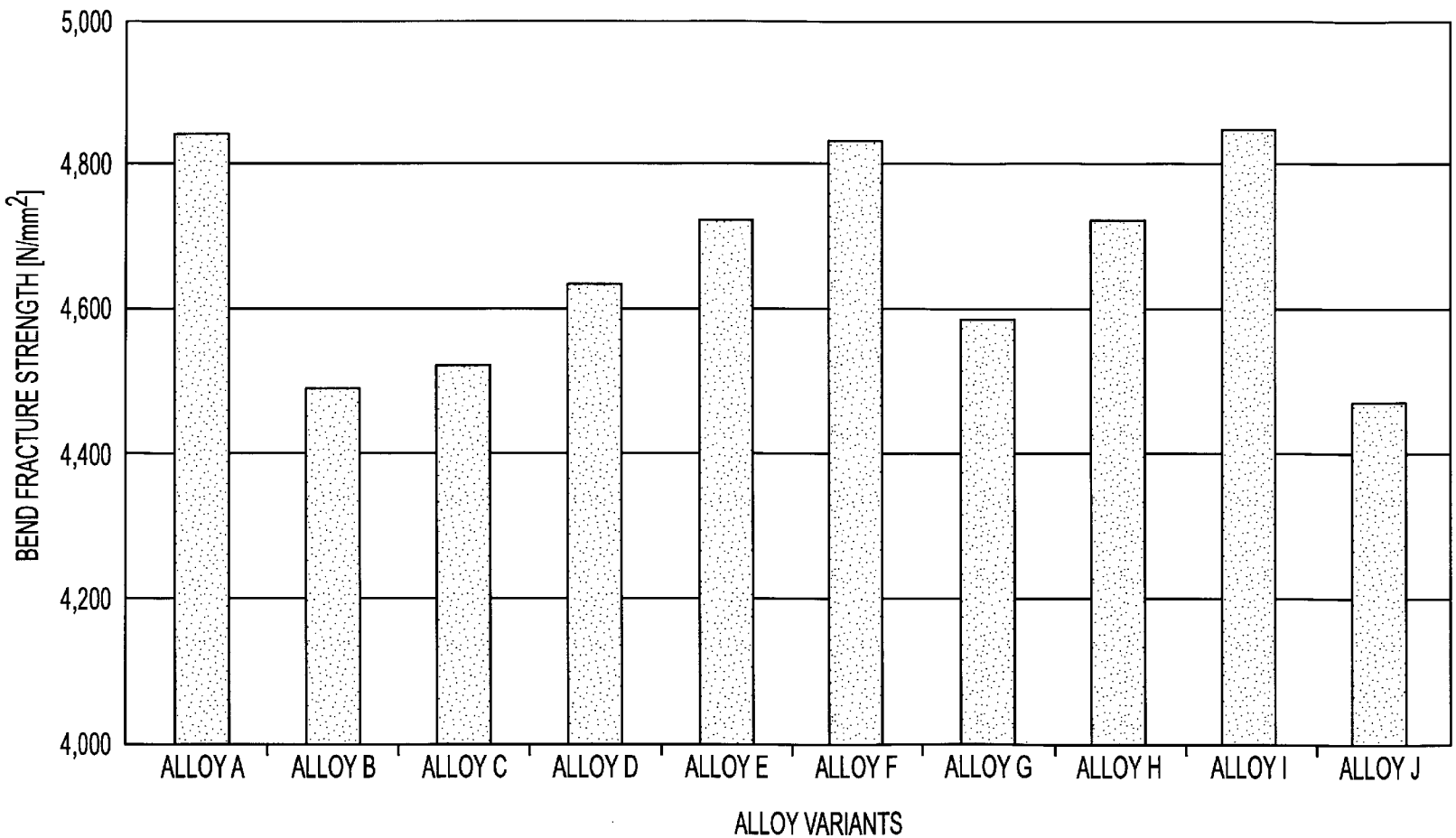
FIG. 4 Comparison of the bend fracture strength of the steel alloys

If the bend fracture strength of alloy A according to the invention is compared to that of the comparative alloys (B through J) (Table 2) shown in a bar chart in FIG. 4, alloys E, F, H and I show equally high values, with alloy I having the highest bend fracture strength.

Figure 5:
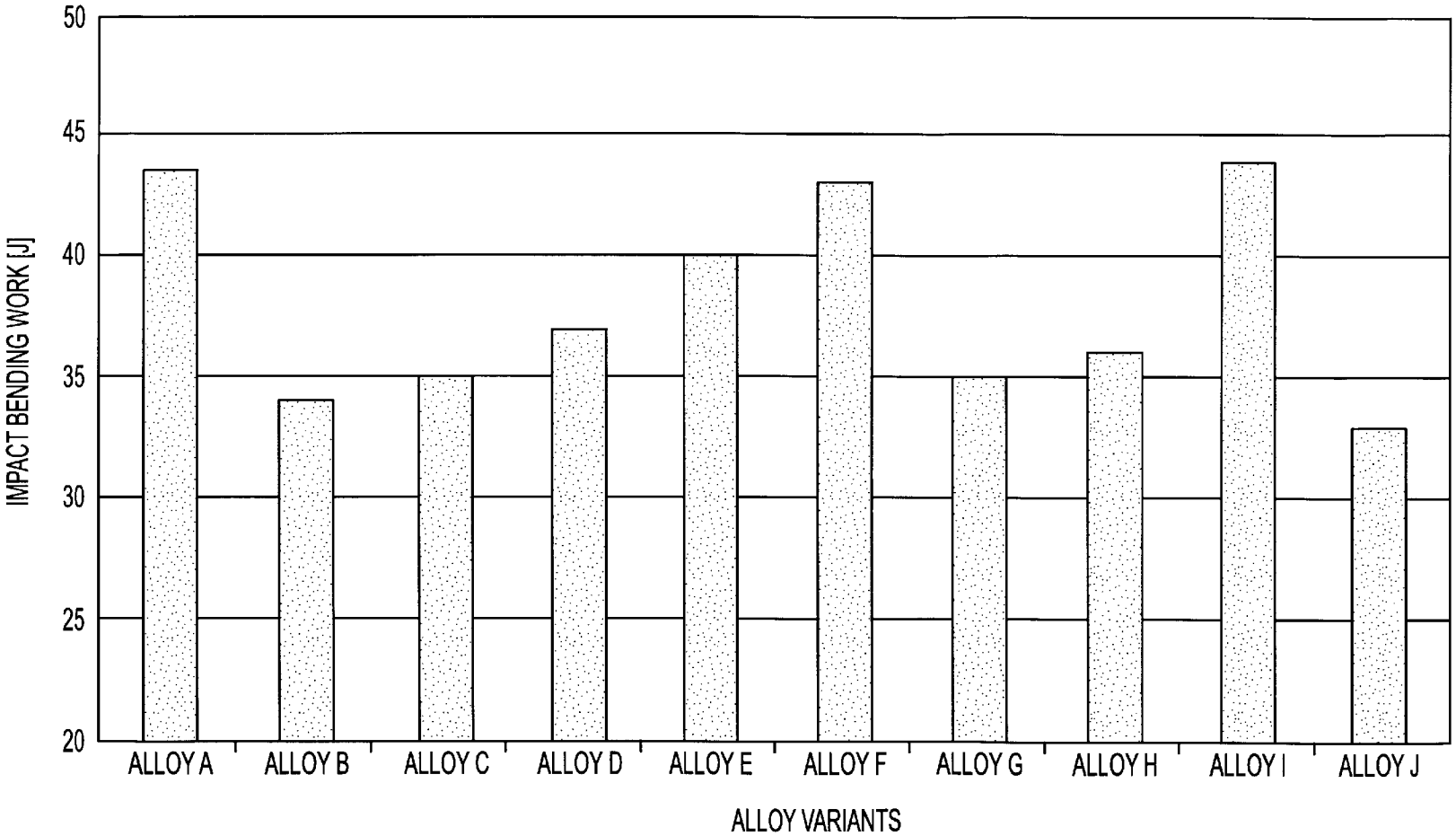
FIG. 5 Comparison of the impact bending work

In a comparison of the respective impact bending work (FIG. 5) of the cold work steel alloys, alloy I again has the highest value. The measurement data for alloy A according to the invention and alloy F exhibit slightly lower values for this mechanical property.

Figure 6:
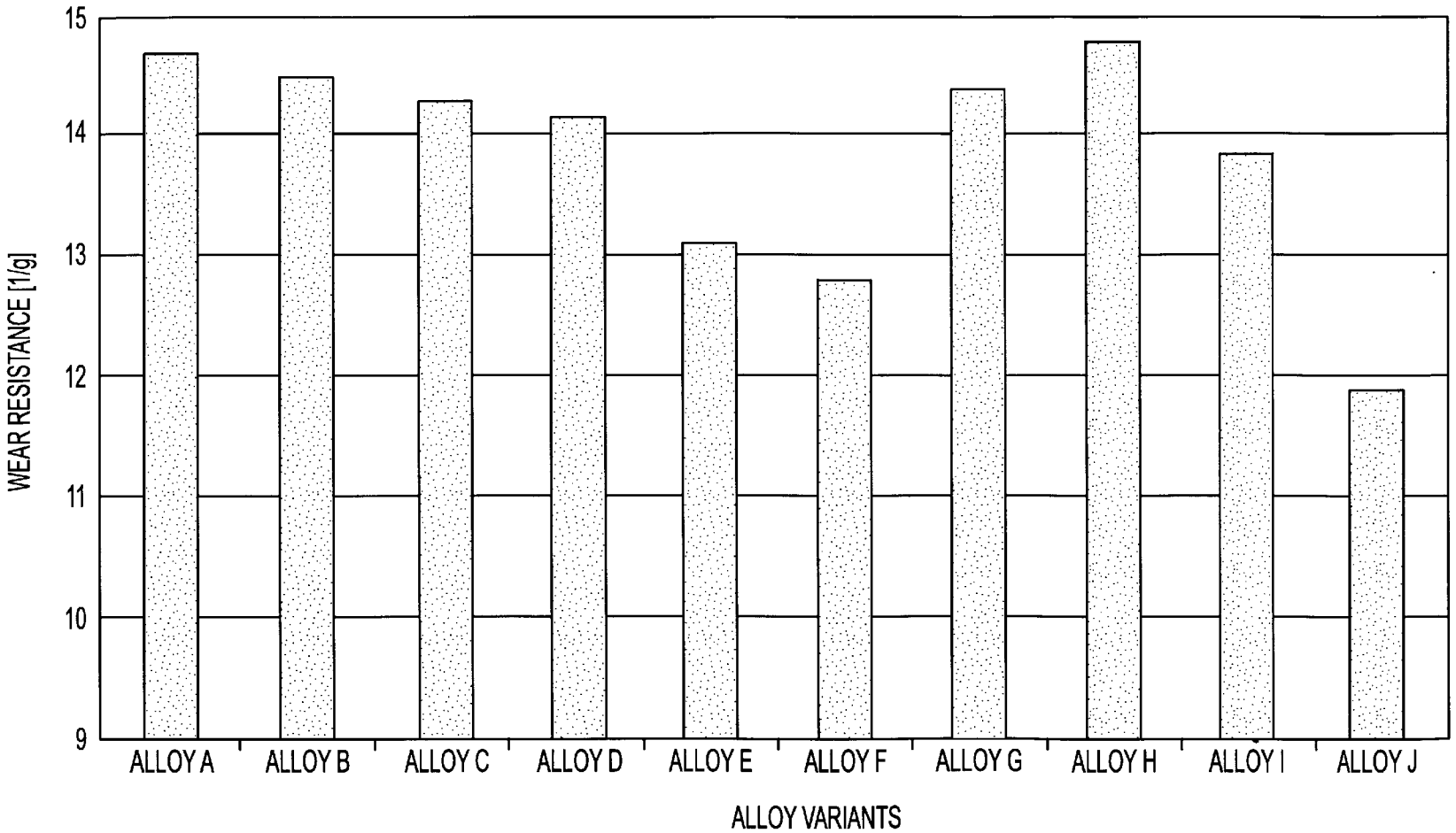
FIG. 6 Comparison of the respective wear resistance of the steel alloys

The results of the tests of the wear resistance of the alloys are compared in a graphic representation in FIG. 6, with the highest values being determined for alloy H and alloy A according to the invention.

It can be seen from the test results that the important properties: bend fracture strength, impact bending work and wear resistance of a cold work steel alloy according to the invention all are at a high level and characterize this new alloy.

TABLE 1

| % by weight | Alloy A* | Alloy B | Alloy C | Alloy D | Alloy E |
|---|---|---|---|---|---|
| C | 2.44 | 2.55 | 2.49 | 2.42 | 2.61 |
| Si | 0.98 | 1.05 | 0.95 | 1.12 | 0.97 |
| Mn | 0.52 | 0.53 | 0.49 | 0.55 | 0.66 |
| Cr | 6.22 | 6.93 | 6.12 | 6.27 | 6.08 |
| W | 1.41 | 0.95 | 2.74 | 1.30 | 1.06 |
| Mo | 3.98 | 3.95 | 3.78 | 4.00 | 3.60 |
| V | 8.12 | 7.85 | 7.92 | 7.88 | 6.77 |
| Nb | 1.19 | 1.15 | 1.12 | 1.86 | 1.45 |
| S | 0.008 | 0.011 | 0.03 | 0.012 | 0.028 |
| N | 0.095 | 0.08 | 0.064 | — | — |
| Co | 0.4 | <0.1 | — | — | <0.1 |
| Ni | 0.7 | 0.43 | 0.17 | 0.28 | 0.89 |
| O | 0.0091 | 0.032 | — | — | 0.041 |

| % by weight | Alloy F | Alloy G | Alloy H | Alloy I | Alloy J |
|---|---|---|---|---|---|
| C | 2.63 | 2.52 | 2.44 | 2.49 | 2.30 |
| Si | 1.13 | 0.87 | 0.94 | 0.63 | 0.32 |
| Mn | 0.71 | 0.55 | 0.50 | 0.32 | 0.31 |
| Cr | 6.21 | 6.28 | 5.66 | 4.19 | 12.31 |
| W | 1.50 | 2.22 | 0.05 | 3.68 | 0.35 |
| Mo | 3.98 | 5.05 | 1.31 | 3.21 | 1.17 |
| V | 7.83 | 8.20 | 9.84 | 8.72 | 3.94 |
| Nb | 0.61 | 0.9 | 0.01 | — | — |
| S | 0.009 | 0.039 | 0.07 | 0.01 | 0.013 |
| N | 0.09 | 0.06 | 0.075 | 0.038 | 0.13 |
| Co | 0.13 | 0.038 | — | — | 0.04 |
| Ni | 0.51 | 0.76 | — | 0.36 | — |
| O | 0.068 | 0.044 | — | 0.054 | 0.0098 |

*Alloy A = alloy according to the invention

TABLE 2

| | Alloy* | Bend fracture strength ($N/mm^2$) Four point bending test | Impact bending work (J) unnotched sample | Wear resistance (l/g) against SiC emery paper |
|---|---|---|---|---|
| Each thermally treated to a hardness of 61 HRC | Alloy A | 4843 | 43.5 | 14.7 |
| | Alloy B | 4487 | 34 | 14.5 |
| | Alloy C | 4524 | 35 | 14.3 |
| | Alloy D | 4636 | 36.8 | 14.15 |
| | Alloy E | 4720 | 39.9 | 13.1 |
| | Alloy F | 4825 | 43 | 12.8 |
| | Alloy G | 4585 | 35 | 14.35 |

TABLE 2-continued

| Alloy* | Bend fracture strength ($N/mm^2$) Four point bending test | Impact bending work (J) unnotched sample | Wear resistance (l/g) against SiC emery paper |
|---|---|---|---|
| Alloy H | 4716 | 36 | 14.73 |
| Alloy I | 4845 | 44 | 13.80 |
| Alloy J | 4468 | 33 | 11.86 |

*Alloy A = alloy according to the invention

What is claimed is:

1. A cold work steel alloy comprising, in percent by weight:

| | |
|---|---|
| C | 2.05 to 2.65 |
| Si | up to 2.0 |
| Mn | up to 2.0 |
| Cr | 6.10 to 9.80 |
| W | 0.5 to 2.4 |
| Mo | 2.15 to 4.70 |
| V | 7.05 to 9.0 |
| Nb | 0.25 to 2.45 |
| Co | up to 10.0 |
| S | up to 0.3 |
| N | 0.04 to 0.32 |
| Ni | up to 1.50 |
| accompanying elements | up to 2.6 |

as well as production-related impurities, with the balance being Fe, said alloy having an oxygen content of less than 100 ppm and a content of nonmetallic inclusions corresponding to a K0 value of a maximum of 3 when tested according to DIN 50 602.

2. The cold work steel alloy of claim 1, wherein the nitrogen content of the alloy is up to 0.22 percent by weight.

3. The cold work steel alloy of claim 1, wherein the alloy comprises one or more element(s) in the following weight percentages:

| | |
|---|---|
| C | 2.30 to 2.59 |
| Si | 0.80 to 1.50 |
| Mn | 0.30 to 1.40 |
| Cr | 6.12 to 7.50 |
| Ni | up to 1.0 |
| W | 0.60 to 1.45 |
| Mo | 2.40 to 4.40 |
| V | 7.40 to 8.70 |
| Nb | 0.50 to 1.95 |
| N | 0.06 to 0.25 |

and the value (Mn—S) is at least 0.19.

4. The cold work steel alloy of claim 1, wherein the alloy comprises one or more element(s) in the following weight percentages:

| | |
|---|---|
| Si | 0.85 to 1.30 |
| Mn | 0.40 to 0.80 |
| Cr | 6.15 to 6.95 |
| Ni | up to 0.90 |
| Mo | 3.55 to 4.40 |
| V | 7.80 to 8.59 |
| Nb | 0.75 to 1.45 |
| N | 0.06 to 0.15. |

5. The cold work steel alloy of claim 3, wherein the alloy comprises one or more element(s) in the following weight percentages:

| | |
|---|---|
| Si | 0.85 to 1.30 |
| Mn | 0.40 to 0.80 |
| Cr | 6.15 to 6.95 |
| Ni | up to 0.90 |
| Mo | 3.55 to 4.40 |
| V | 7.80 to 8.59 |
| Nb | 0.75 to 1.45 |
| N | 0.06 to 0.15. |

6. The cold work steel alloy of claim 1, wherein the alloy comprises, in percent by weight:

| | |
|---|---|
| C | 2.44 |
| Si | 0.98 |
| Mn | 0.52 |
| Cr | 6.22 |
| W | 1.41 |
| Mo | 3.98 |
| V | 8.12 |
| Nb | 1.19 |
| S | 0.008 |
| N | 0.095 |
| Co | 0.4 |
| Ni | 0.7 |
| O | 0.0091. |

7. The cold work steel alloy of claim 1, wherein the alloy is in the form of a part.

8. The cold work steel alloy of claim 7, wherein the part is a tool.

9. The cold work steel alloy of claim 1, wherein the alloy is in the form of a metal powder.

10. The cold work steel alloy of claim 9, wherein the metal powder has a grain size distribution wherein at least 60% of the grains have a grain size of not more than 100 $\mu$m.

11. The cold work steel alloy of claim 10, wherein the metal powder has been produced by gas atomization of a liquid alloy.

12. The cold work steel alloy of claim 11, wherein the gas comprises nitrogen.

13. A tool comprising the cold work steel alloy of claim 3.

14. The tool of claim 13, wherein the alloy comprises monocarbides, said monocarbides having a diameter of less than 10 $\mu$m.

15. A part made of the cold work steel alloy of claim 5.

16. The part of claim 15, wherein the alloy comprises monocarbides, said monocarbides having a diameter of less than 4 $\mu$m.

17. A part made of a cold work steel alloy comprising, in percent by weight:

| | |
|---|---|
| C | 2.30 to 2.59 |
| Si | 0.85 to 1.30 |
| Mn | 0.40 to 0.80 |
| Cr | 6.15 to 6.95 |
| Ni | up to 0.90 |
| W | 0.60 to 1.45 |
| Mo | 3.55 to 4.40 |
| V | 7.80 to 8.59 |
| Nb | 0.75 to 1.45 |
| Co | up to 10.0 |

-continued

| | |
|---|---|
| S | up to 0.3 |
| N | 0.06 to 0.15 |
| accompanying elements | up to 2.6 |
| (Mn-S) | at least 0.19 |

as well as production-related impurities, with the balance being Fe, wherein said alloy has an oxygen content of less than 100 ppm and a content of nonmetallic inclusions corresponding to a K0 value of a maximum of 3 when tested according to DIN 50 602.

18. The part of claim 17, wherein the part is a tool.

19. The part of claim 18, wherein the alloy comprises monocarbides, said monocarbides having a diameter of less than 4 μm.

20. The part of claim 17, wherein the part has been produced by a process comprising hot isostatic pressing of a metal powder.

21. The part of claim 20, wherein the metal powder has a grain size distribution wherein at least 60% of the grains have a grain size of not more than 100 μm.

22. A method for making a part of a cold work steel alloy, said method comprising conditioning and atomizing a liquid alloy which comprises, in percent by weight:

| | |
|---|---|
| C | 2.05 to 2.65 |
| Si | up to 2.0 |
| Mn | up to 2.0 |
| Cr | 6.10 to 9.80 |
| W | 0.50 to 2.40 |
| Mo | 2.15 to 4.70 |
| V | 7.05 to 9.0 |
| Nb | 0.25 to 2.45 |
| Co | up to 10.0 |
| S | up to 0.3 |
| N | 0.04 to 0.32 |
| Ni | up to 1.50 |
| accompanying elements | up to 2.6 |

as well as production-related impurities, with the balance being iron;

with nitrogen having a purity of at least 99.999% to produce a metal powder with a grain size distribution wherein at least 60% of the grains have a grain size of not more than 100 μm, whereafter, while maintaining a nitrogen atmosphere and avoiding a physisorption of oxygen at grain surfaces, the metal powder is subjected to a hot isostatic pressing process to produce a completely dense material comprising evenly distributed monocarbides of a diameter of less than 10 μm.

23. The method of claim 22, wherein the part has an oxygen content of less than 100 ppm.

24. The method of claim 23, wherein the part is a tool.

25. The method of claim 23, wherein the part has a content of nonmetallic inclusions corresponding to a K0 value of a maximum of 3 when tested according to DIN 50 602.

26. The method of claim 24, wherein the monocarbides have a diameter of less than 4 μm.

27. The method of claim 22, wherein the hot isostatic pressing process is followed by a hot working process.

28. The method of claim 27, wherein the hot working process comprises at least one of forging and rolling.

29. The method of claim 22, wherein the alloy comprises one or more element(s) in the following weight percentages:

| | |
|---|---|
| C | 2.30 to 2.59 |
| Si | 0.80 to 1.50 |
| Mn | 0.30 to 1.40 |
| Cr | 6.12 to 7.50 |
| Ni | up to 1.0 |
| W | 0.60 to 1.45 |
| Mo | 2.40 to 4.40 |
| V | 7.40 to 8.70 |
| Nb | 0.50 to 1.95 |
| N | 0.06 to 0.25 |

and the value (Mn—S) is at least 0.19.

30. The method of claim 29, wherein the alloy comprises one or more element(s) in the following weight percentages:

| | |
|---|---|
| Si | 0.85 to 1.30 |
| Mn | 0.40 to 0.80 |
| Cr | 6.15 to 6.95 |
| Ni | up to 0.90 |
| Mo | 3.55 to 4.40 |
| V | 7.80 to 8.59 |
| Nb | 0.75 to 1.45 |
| N | 0.06 to 0.15. |

31. The method of claim 22, wherein the alloy comprises, in percent by weight:

| | |
|---|---|
| C | 2.30 to 2.59 |
| Si | 0.85 to 1.30 |
| Mn | 0.40 to 0.80 |
| Cr | 6.15 to 6.95 |
| Ni | up to 0.90 |
| W | 0.60 to 1.45 |
| Mo | 3.55 to 4.40 |
| V | 7.80 to 8.59 |
| Nb | 0.75 to 1.45 |
| Co | up to 10.0 |
| S | up to 0.3 |
| N | 0.06 to 0.15 |
| accompanying elements | up to 2.6 |
| (Mn-S) | at least 0.19; |

wherein the part is a tool having an oxygen content of less than 100 ppm and a content of nonmetallic inclusions corresponding to a K0 value of a maximum of 3 when tested according to DIN 50 602, wherein the monocarbides have a diameter of less than 4 μm, and wherein the hot isostatic pressing process is followed by at least one of forging and rolling.

* * * * *